United States Patent [19]

Nemeth

[11] 4,370,543

[45] Jan. 25, 1983

[54] SHOWER-SAUNA INSTANTANEOUS ELECTRIC STEAM OR HOT WATER SUPPLY UNIT

[76] Inventor: Laszlo Nemeth, Carrera 67 #50-33, Bogata, Colombia

[21] Appl. No.: 191,222

[22] Filed: Oct. 6, 1980

[51] Int. Cl.[3] ..... F22B 1/30; H05B 3/60; A61H 33/06

[52] U.S. Cl. ..... 219/275; 4/526; 4/533; 4/534; 4/598; 4/610; 128/367; 137/341; 219/289; 219/292

[58] Field of Search ..... 219/271–276, 219/284–295; 4/524–536, 598, 610; 137/341; 128/367

[56] References Cited

U.S. PATENT DOCUMENTS

| | | | |
|---|---|---|---|
| 616,668 | 12/1898 | Hills | 4/610 |
| 887,331 | 5/1908 | Johnson | 219/292 X |
| 1,999,962 | 4/1935 | Des Rosiers | 219/293 |
| 2,398,136 | 4/1946 | Drabble et al. | 219/289 X |
| 2,748,253 | 5/1956 | Bremer | 219/291 X |
| 2,790,890 | 4/1957 | Kasuga | 219/287 |
| 2,846,692 | 8/1958 | Baumann | 4/531 |
| 2,902,580 | 9/1959 | Lowe et al. | 4/533 X |
| 3,025,533 | 3/1962 | Hair | 4/534 X |
| 3,048,852 | 8/1962 | Schoneberg | 4/532 |
| 4,092,519 | 5/1978 | Eaton-Williams | 219/289 X |

FOREIGN PATENT DOCUMENTS

| | | | |
|---|---|---|---|
| 708966 | 5/1931 | France | 219/291 |
| 411549 | 6/1945 | Italy | 219/292 |
| 424106 | 8/1947 | Italy | 219/293 |

*Primary Examiner*—A. Bartis
*Attorney, Agent, or Firm*—Antonelli, Terry & Wands

[57] ABSTRACT

A shower-sauna apparatus includes an electrically insulative container for accomodating a volume of water to be heated. A vertical central tube extends through the container and has a threaded upper end adapted to be connected to a source of water and a threaded lower end through which steam or hot water is discharged into a sauna-shower area defined by a flexible curtain suspended from a flat dish-shaped member secured to the threaded lower end of the central tube and defining the top wall of the sauna-shower area. A plurality of spaced, tubular electrode plates are disposed in the container and are adapted to be connected to an electric power source for passage of electric current through the water between the plates to generate Joule heat for automatically and instantaneously heating the volume of water to enable generation of either steam or hot water. The central tube is divided by a stopper into an upper water inlet portion and a lower steam or hot water outlet portion. A water control valve is provided to regulate the rate of water flow into the container and thus control the generation of steam or the temperature to which the water is heated. A shower head can be either attached directly to the lower end of the control tube or connected thereto by a flexible hose. A check valve prevents generated steam from exiting through the upper end of the central tube. Alternatively, a dish filled with aromatic or medicinal herbs can be connected to the hose when steam is to be delivered to the sauna-shower area.

8 Claims, 8 Drawing Figures

SHOWER-SAUNA INSTANTANEOUS ELECTRIC STEAM OR HOT WATER SUPPLY UNIT

The present invention relates to an automatic and instantaneous shower-sauna system for converting running water into either hot water for a shower of steam for a sauna.

In accordance with the present invention a system is provided which employs a plurality of inoxdizable metallic plates for instantaneously heating the water to be used for the shower or the sauna. The plates submerged in the water only serve to facilitate the passage of electric current.

One advantage of the present invention resides in the fact that durability of the heater of the present invention is theoretically infinite because the heater is not a resistance type heater such as other types of heaters which generally employ a red-hot resistance wire of, for example, ferro nickel. In the construction of the present invention, the resistance is the water itself and the water is never damaged.

While the heater of the construction of the present invention can theoretically have an infinite durability, and as can be appreciated, in daily use, some damage can occur to the heater plates especially when employed with dirty water since dirty water may introduce metal particles into the container of the system resulting in a covering of the metallic plates and a short circuiting. However, in a normal environment, the plates of the heater can last for many years, rendering instantaneous service for an entire family at a relatively low price.

A further advantage of the present invention resides in the fact that an instantaneous quality heating system can be provided at a relatively low cost with a minimum amount of maintenance.

Yet another advantage of the present invention resides in the fact that the system can readily be installed anywhere in the world since the heater can be connected to any voltage.

These and other features and advantages of the present invention will become more apparent from the following description when taken in connection with the accompanying drawings which show, for the purposes of illustration only, one embodiment in accordance with the present invention, and wherein.

Figure 1:
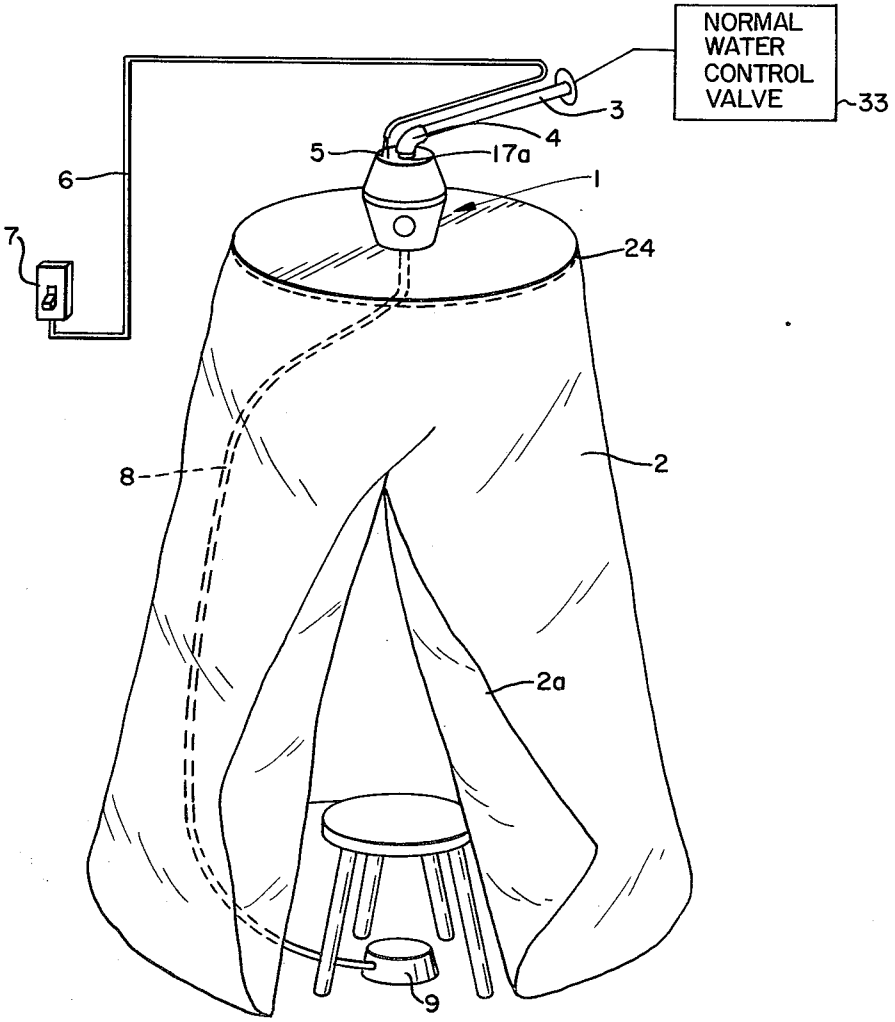
FIG. 1 is a perspective view of a shower-sauna constructed in accordance with the present invention.

Referring now to the drawings wherein like reference numerals are used throughout the various views to designate like parts and, more particularly, to FIG. 1, according to this figure, the shower and sauna include an electrical apparatus formed as a bulb or container generally designated by the reference numeral 1 of, for example, vulcanized rubber or other suitable material, with the container 1 being connected by a sauna tube or pipe 3 to a water pipe (not shown) of an apartment or house water system. A nipple or elbow 4 connects the sauna tube 3 with a nipple 17*a*. The container 1 supports a sauna curtain 2 or the like in a manner to be described more fully hereinafter. An electrical switch 7 serves to control, via 6, the introduction of electrical energy to inputs 5 of container 1.

Figure 2:
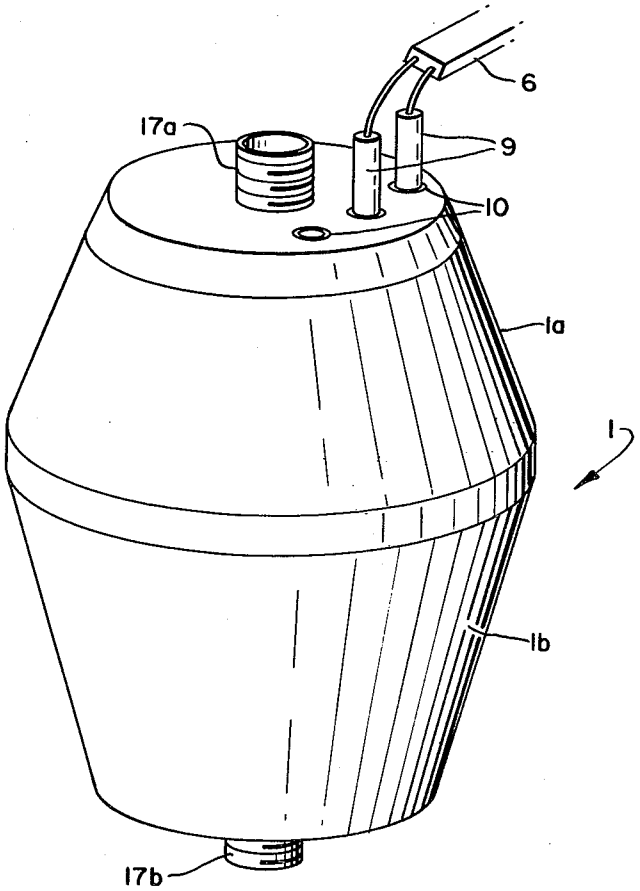
FIG. 2 is a plan view of a container or tank having the electro-apparatus of the shower-sauna of the present invention.
Figure 3:
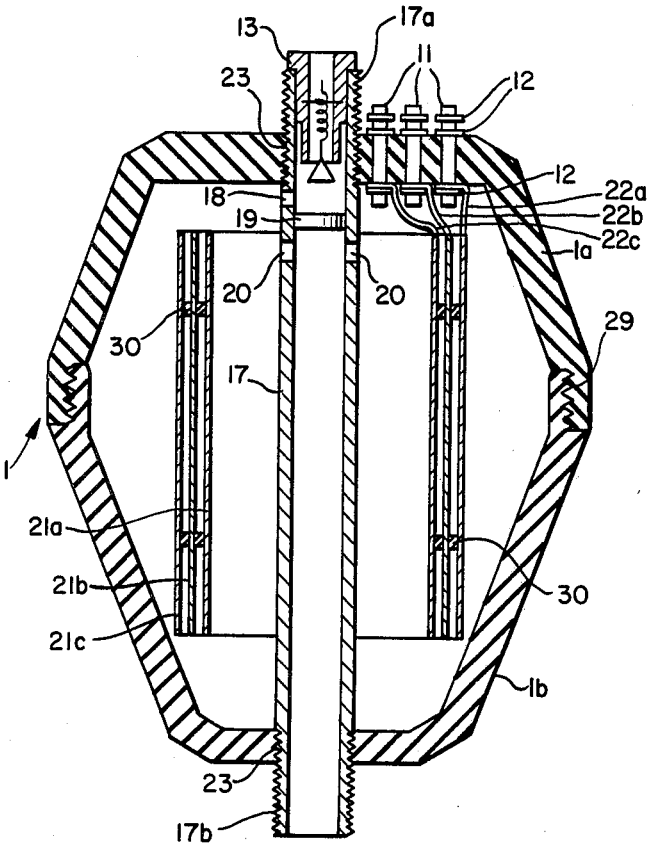
FIG. 3 is a longitudinal cross sectional view of the electrical apparatus of FIG. 2.

As shown most clearly in FIGS. 2 and 3, the container 1 is formed of two parts 1*a*, 1*b* joined together by a threaded nipple portion 29. The upper part 1*a* and lower part 1*b* of the container 1 is provided with threaded inlet and outlet cavities or openings threadably engageable at 23 with inlet or outlet nipples 17*a*, 17*b* of a central tube 17 which has different functions. First of all, in an upper part of the central tube 17, running water enters the heating system, passes through the same and comes out as a heat carrier either in the form of steam or hot water. The upper part or nipples 17*a* of the tube 17 is connected, by the elbow 4, to the water pipes 3 (FIG. 1) in a house or apartment.

Figure 5:
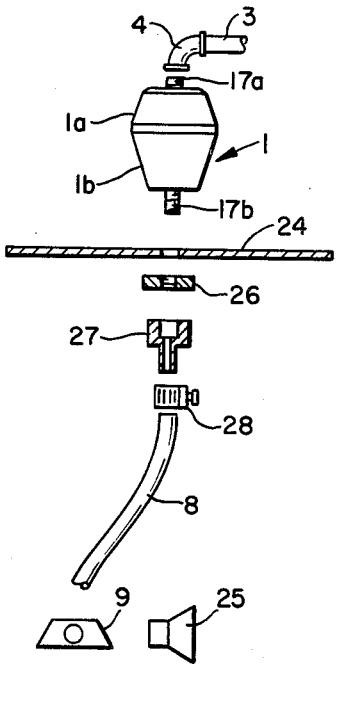
FIG. 5 is an exploded view of the mounting of the sauna support at the container or tank housing the electrical apparatus.
Figure 6:
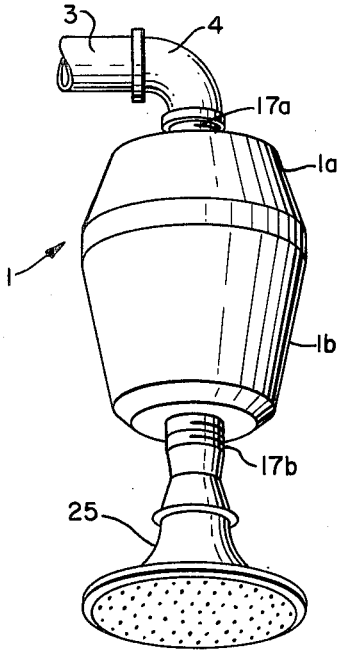
FIG. 6 is a perspective view of a shower head mounted on the tank or container housing the electrical apparatus of the shower-sauna of the present invention.

As shown most clearly in FIG. 5, a big dish or plate 24 with a diameter of approximately 0.60–0.80 meters, supports the sauna curtain 2 with the disc 24 being mounted to the nipple 17*b* by a nut 26 and with a plastic tube 8 through which passes the steam to the floor of the bath where it spreads out and fills the sauna from the bottom to the top. The tube 8 is connected to the nipples 17*b* by an adapter 27 and a clamp 28.

Figure 4:
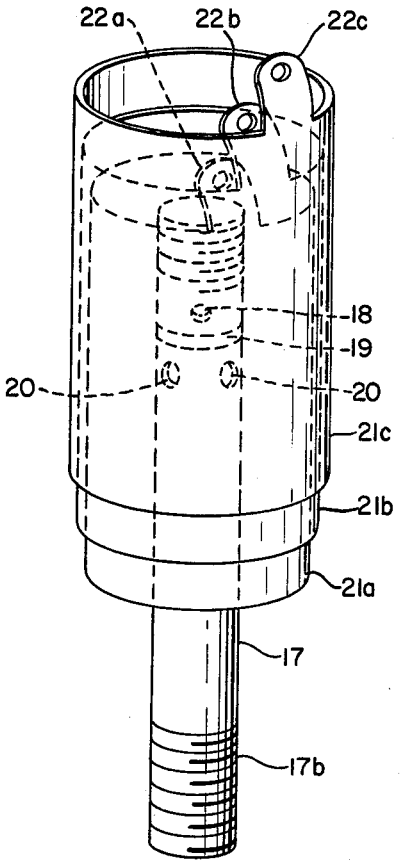
FIG. 4 is an exploded view of a central tube assembly of the shower-sauna of the present invention.

As shown most clearly in FIGS. 3 and 4, a plurality of tubular shaped plates or sheets 21*a*, 21*b*, 21*c* of non-oxidizable steel are disposed around the central tube 17, with the plates or sheets 21*a*, 21*b*, 21*c* facilitating a passage of electric current when the container 1 is filled with water based on the following principles.

The overall effectiveness of the system of the present invention is based upon the principle that if two metals are separately introduced into water and connected to an ordinary electric current by a two wire cable, both positive and negative, the water begins to get heated because there are salts, metals and other elements in the water which are used by electrons passing at a great speed from a negative pole to the positive pole thereby producing Joule heating of the water molecules as a result of which the temperature of the water is raised. The closer the metals in the form of metallic sheets or plates are moved toward each other, the more resistance declines and the sooner the water will get hot. The effectiveness of the sheets or plates increases by increasing their effective surface.

The plates or electrodes 21*a*, 21*b*, 21*c* are firmly mounted in the upper part 1*a* of the container 1 by terminals 22*a*, 22*b*, 22*c* and screws 11, accommodated in holes 10, and nuts 12, with the screws 11 and nuts 12 being made of copper. The screws 11 are connected as shown at 5 in FIG. 1 through a power line 6 to a source of electrical power with switch 7 controlling the supply of electric current. Current insulators 30 are disposed between the respective sheets 21*a*, 21*b*, 21*c* for the purpose of maintaining the distance calculated between the respective sheets.

Figure 7:
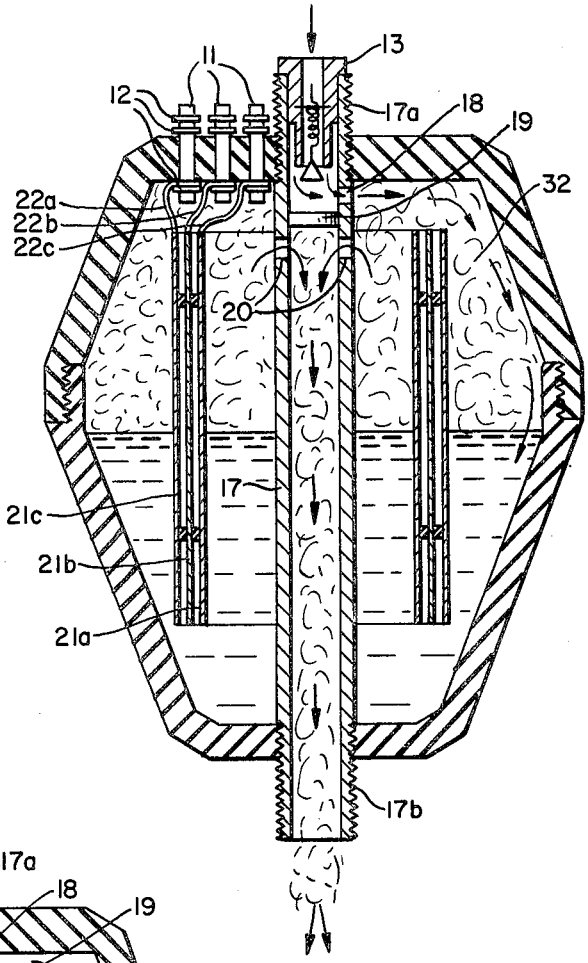
FIG. 7 is a cross sectional view of the tank or container of the shower-sauna of the present invention illustrating operating principles of the invention when the apparatus is generating steam.
Figure 8:
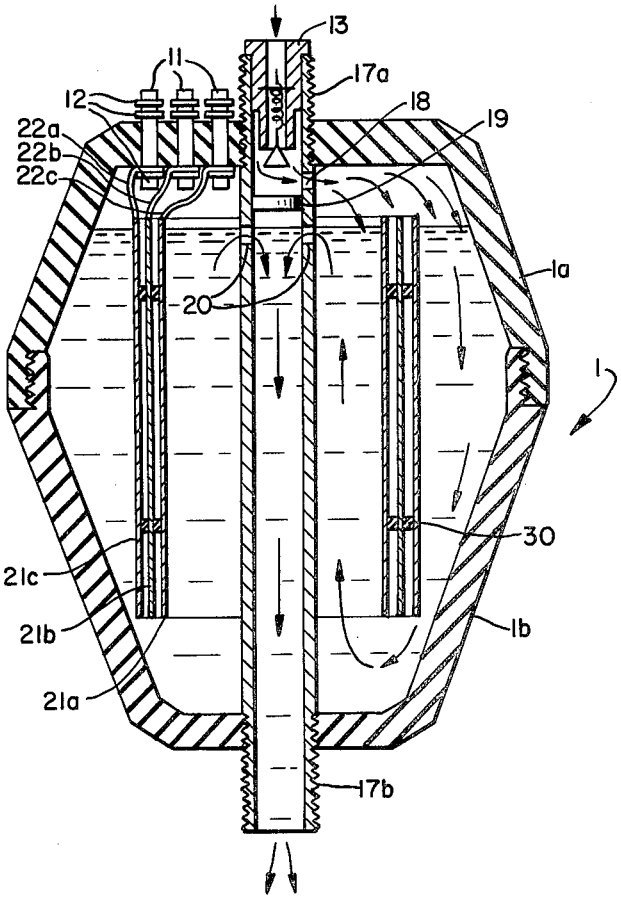
FIG. 8 is a cross sectional view similar to FIG. 7 illustrating operating principles of the shower-sauna of the present invention when the system is supplying hot water.

The sauna-shower of the present invention may automatically generate steam or vapor in the following manner:

As shown most clearly in FIG. 7, water enters the container 1 by going through a check valve 13, with the check valve 13–16 functioning to prevent steam 32 generated in the container 1 from escaping the container 1 and flowing into the water pipe 3. Immediately after entering the container 1, water contacts an aluminum stopper 19 which divides the central tube 17 into two parts. The stopper 19 diverts the water which, through a cavity or opening 18 made on one side of the central tube 17, penetrates into an interior of the heater.

After closing the electrical circuit by the switch 7 (FIG. 1), the passage of electric current begins when the water level reaches the plates 21*a*, 21*b*, 21*c*.

As the surfaces of the plates 21*a*, 21*b*, 21*c* become more immersed in the rising water level, the passage of electric current will be increased and the water consequently gets hot faster. When the water covers all the plates 21*a*, 21*b*, 21*c*, the heater is working at maximum capacity. However, the water cannot be transformed into steam in this manner.

For generation of steam 32 it is not necessary to fill the container 1 completely but only approximately half way up. For this purpose, the register or normal water control valve 33, FIG. 1, is opened very little, so that the same volume of water may come into the container 1 as goes out in the form of steam 32. The steam 32 comes out of the container 1 through two holes 20 (FIGS. 4 and 7) made in the central tube 17, below the stopper 19. In the lower part of the central tube 17, by means of the adapter 27 (FIG. 5), the plastic tube 8 is connected to the nipple 17*b* to allow the tube 8 to conduct the steam 32 to the floor of the sauna.

As shown in FIG. 1, a lower point of the elastic tube 8 is introduced into a common ordinary dish where the steam spreads out with much intensity and in a few minutes, almost instantaneously fills the sauna.

The sauna curtain 2 is formed as an awning consisting of plastic or some other suitable material which can be closed hermetically so that the steam will not escape and which can have different shapes such as square or round.

The inside temperature of the sauna is adjusted gradually by the entrance door 2*a* to the same. If the door 2*a* is kept closed, the temperature will go up to more than 50° C. The electric energy consumption is at a minimum since the sauna only consumes between 6 and 8 amps per hour, equivalent to 700–800 w, at 110 v. Explained in more popular terms, the sauna's consumption is similar to that of an electric hot plate. It can be installed anywhere provided there are electric and water outlets, but the best place is the bathroom right off the bedroom.

The sauna may be very simply installed in the following manner:

To install the sauna the pipe (not shown) of the shower already installed in the bathroom of the house or apartment is unscrewed and sauna tube 3, which has a threaded portion with the length of approximately 40 cm and a diameter of 0.5 inches, is threadably attached to the pipe of the shower. The elbow 4, with the same diameter, is threadably attached to an opposite end of the sauna tube 3. The nipple 17*a* of the heater of the sauna is then threadably joined in the elbow 4, thereby mounting the container 1 to the sauna tube 3. After the container 1 is mounted, the dish or plate 24 of, for example, aluminum or inoxidizable steel is mounted on the container 1, with the dish 24 being sufficiently strong to support the sauna curtain 2. Finally, the hose or plastic tube 8 is mounted under the dish 24 by the adapter 27, fastened by the clamp 28.

A minidouche, shower head 25, a pot or dish 9 into which aromatic or medicinal herbs have been placed may then be located at the other end of the house or tube 8.

As shown in FIG. 5, a mini showerhead 25 may be provided so as to enable a person inside the sauna wishing to cool off to merely attach the head 25 to the end of the hose or tube 8. In this case, what the person has to do is merely open the water register or control valve more, such that the water rapidly goes through the container 1, whereby there is not sufficient time for the water to be in contact with the plates 21*a*, 21*b*, 21*c* so as to cause the water to get hot. Thus, the water comes out through the mini douche or showerhead 25 either tepid or cold.

After refreshing oneself with the minishower, if the person wishes to continue the use of the sauna bath, a person can do so as many times as desired. All one has to do is completely close the register or control valve and the steam will instantaneously once again begin to fill the sauna. About approximately 2 minutes later, the register or control valve is once again opened, but only a tiny little bit, in order continually to replace the water which escapes in the form of steam 32.

The apparatus of the present invention may be used as a shower which automatically makes hot water in the following manner:

If a person does not wish to use the sauna and only wishes to take a daily shower with hot water, this can be done as many times as desired. In this case, all one has to do is remove the dish or plate 24 which supports the sauna curtain 2 by loosening the nut 26, even though it is not necessary, since it is possible only to unscrew and remove the adapter 27 the hose 8 and replace the same with the shower head 25 which is ready for use. If desired, the sauna curtain 2 can be stored above the dish 24.

The operation of the heater for a shower is the same as for the sauna. More particularly, the water register or control valve is open and the heater is automatically connected and water of any temperature can instantaneously be obtained. The temperature of the water is graduated or controlled by the same register or control valve which controls the volume of water flowing through the container 1. With a small volume, the temperature of the water goes up. As the speed of water passage increases, the temperature of the water goes down. This is the graduation system of the heater, that is to say, the heat of the water is graduated by the volume of water running through the container 1. The hot water service obtained when used as a shower is instantaneous, like that of the sauna.

I claim:

1. Apparatus for a shower and sauna comprising a container means of electrically insulative material for accommodating a volume of water, a substantially vertical central tube means extending through the container means for supplying water into the container means and removing hot water and steam from the container means, means provided on the upper end of the tube means for enabling a connecting of the central tube means to a source of water, means for automatically and instantaneously heating the volume of water in the container means so as to enable a generation of one of hot water and steam including a plurality of spaced tubular electrically conductive plates disposed in the container means and means for connecting the tubular plates with the source of electric current for passage of electric current through the water between the plates to generate Joule heat, means firmly mounting the tubular plates in the container means, means for mounting a sauna curtain on the container so as to define a sauna area below the container means including a flat dish-shaped member of a size and shape defining the top wall of the sauna area mounted on a lower end of the central tube means, means for releasably securing the dish-shaped member to the central tube means, means provided in the central tube means for distributing the water supply to the container means and removing generated steam or hot water from the container means, the lower end of the central tube means forming an exit for steam and hot water to the sauna area and means provided for maintaining a predetermined spacing between the respective tubular plates.

2. Apparatus for a shower and sauna according to claim 1, wherein the container means includes an upper part and a lower part, means are provided for joining the upper part to the lower part, the means for firmly mounting the tubular plates includes a plurality of mounting holes provided in the container means, electrically conductive fastening means accommodated in the mounting holes, and bent lug means provided on each of the plurality of tubular plates and cooperating with the fastening means for securing the respective plates in the container means.

3. Apparatus for a shower and sauna according to one of claims 1 or 2, wherein a check valve means is arranged at an upper end of the central tube means for preventing a steam generated in the container means from flowing out of the container through an inlet end of the central tube means.

4. Apparatus for a shower and sauna according to claim 3, characterized in that the means for maintaining a predetermined spacing between the respective tubular plates includes insulators, the tubular plates are formed of an inoxidizable metal, and the means for connecting the tubular plates with a source of electric current includes an electric cable and a selectively operable switch means for controlling an operation of the heating means to cause electric current flow through water bridging the space between adjacent tubular plates.

5. Apparatus for a shower and sauna according to claim 2, wherein the means provided on the upper end of the central tube means for enabling a connecting of the central tube means to a source of water includes a threaded portion adapted to receive an elbow means threadably attached to a pipe means of a water system.

6. Apparatus for a shower and sauna according to claim 5, wherein the lower end of the central tube means includes a threaded portion, the means for releasably securing the dish-shaped member includes a nut cooperable with the threaded portion on the lower end of the central tube means to secure the dish-shaped member in position.

7. Apparatus for a shower and sauna according to claim 6, further comprising a tubular means for directing steam from the heating means into a lower portion of the sauna area, an adapter means for connecting the tubular means to a threaded portion of the lower end of the central tube means for distributing steam and water to the sauna area.

8. Apparatus for a shower and sauna according to claim 7, further comprising:

a shower head means adapted to be attached to a free end of the tubular means, and wherein the container means is made of electrically non-conductive material and wherein the upper and lower parts of the container means comprise a top wall, a bottom wall and a side wall defining a closed container, the central tube means comprises a central tube extending through the container means and having ends projecting through the top and bottom walls respectively to form connecting portions, the end extending through the top wall adapted to be connected to an elevated water pipe having a normal water control valve, the end projecting through the bottom wall being connected to and carrying as an extension thereof the threaded portion of the central tube means and stopper means positioned in the central tube below the top wall and dividing the central tube into an upper water inlet portion and a lower steam and water outlet portion, first aperture means in the central tube above the stopper means for allowing entry of cold water into the container means, second aperture means below the stopper means for allowing exit of steam and water from the container means, and wherein the flat dish member is approximately 0.6–0.8 meters in width so as to define a sauna area large enough to accommodate a person, and a sauna curtain supported from the dish shaped member so as to define the sauna area.

* * * * *